United States Patent [19]

Radzyner et al.

[11] 3,937,944

[45] Feb. 10, 1976

[54] ELECTRONIC CIRCUITRY AND IN PARTICULAR TO CIRCUITRY FOR THE CROSS FEED CANCELLATION OF SECOND ORDER DISTORTION

[76] Inventors: Robert Radzyner, 35 Culver St., Kogarah, New South Wales; Warwick Harvey Holmes, 3 Bortfield Drive, Chiswick, New South Wales, both of Australia

[22] Filed: Dec. 14, 1973

[21] Appl. No.: 424,881

[30] Foreign Application Priority Data

Dec. 15, 1972 Australia ..... 1630/72

[52] U.S. Cl. ..... 235/184; 235/194; 328/163; 325/42

[51] Int. Cl.[2] ..... G06G 7/16

[58] Field of Search ..... 235/184, 193, 194, 195, 235/196; 328/162, 163, 165, 167; 325/42, 65, 446, 371, 472

[56] References Cited

UNITED STATES PATENTS

| | | | |
|---|---|---|---|
| 2,835,444 | 5/1958 | Blake et al. | 235/194 |
| 3,432,650 | 3/1969 | Thompson | 235/194 |
| 3,602,707 | 8/1971 | Jones | 235/194 X |
| 3,629,567 | 12/1971 | Bruggeman | 235/194 |
| 3,737,686 | 6/1973 | Swanekamp | 235/194 |

*Primary Examiner*—Joseph F. Ruggiero
*Attorney, Agent, or Firm*—Brisebois & Kruger

[57] ABSTRACT

The invention relates to a method of reducing the second and higher order distortion in electronic devices such as multipliers by feeding cross feed signals to the inputs whereby the output signal is a function of the original signals and the cross feed input signals.

9 Claims, 5 Drawing Figures

ELECTRONIC CIRCUITRY AND IN PARTICULAR TO CIRCUITRY FOR THE CROSS FEED CANCELLATION OF SECOND ORDER DISTORTION

BACKGROUND OF THE INVENTION

This invention relates to improvements in electronic circuitry, and in particular to the reduction of distortion in electronic devices whose principal desired function is the performance of nonlinear operations. An important special case is the reduction of second-order distortion in devices performing a multiplication operation.

SUMMARY OF THE INVENTION

The present invention provides a method for the reduction of undesired second and higher order distortion products present in the signal(s) $w_1, w_2, \ldots, w_M$ appearing at the M outputs of an imperfect nonlinear electronic device which has input signals $u_1, u_2, \ldots, u_N$ applied to its N inputs, where N is an integer greater than unity and M is an integer greater than zero, and where input $u_n$ is applied to the n-th input, n being an integer lying between 1 and N inclusive, characterised in that cross-feed connections are incorporated at the inputs of the nonlinear electronic device in such a way that instead of applying the input signals $u_1, u_2, \ldots, u_N$ directly to the N inputs of the imperfect nonlinear electronic device, the signals $u_1', u_2', \ldots, u_N'$ actually applied to the N inputs of the electronic device are individually functions of at least one of the input signals $u_1, u_2, \ldots, u_N$, that at least one of the signals $u_1', u_2', \ldots, u_N'$ is a nontrivial function of at least two of the signals $u_1, u_2, \ldots, u_N$, that the functional relations between the signals $u_1', u_2', \ldots, u_N'$ and $u_1, u_2, \ldots, u_N$ are either linear or non-linear, and that the signal $u_n'$ is a non-trivial function of at least the signal $u_n$, where $n$ is any integer between 1 and N inclusive.

The following terms will first be defined before proceeding with the description of the invention:

nonlinear operations
nonlinear device
distortion
order of distortion
distortion product
multiplier

GENERAL DEFINITIONS:

Definition 1 — Nonlinear Operation

Suppose an electronic device has N inputs and M outputs, where N and M are integers greater than unity. Let $u_1, u_2, \ldots, u_N$ be the N signals or variables applied respectively to the N inputs. Let $v_1, v_2, \ldots, v_M$ be the signals or variables appearing at the M outputs when $u_1, u_2, \ldots, u_N$ are applied to the N inputs. Let the function of the electronic device be described by the following functional relationships between the $v_j$ ($j = 1, 2, \ldots, M$) and the $u_i$ ($i = 1, 2, \ldots, N$):

$$\left.\begin{aligned} v_1 &= G_1(u_1, u_2, \ldots, u_N), \\ v_2 &= G_2(u_1, u_2, \ldots, u_n), \\ v_M &= G_M(u_1, u_2, \ldots, u_n). \end{aligned}\right\} \quad (1)$$

It is customary to write this set of equations in vector notation as $$v = G(u) \quad (2)$$

where $v$ denotes the set $(v_1, v_2, \ldots, v_M)$, $u$ denotes the set $(u_1, u_2, \ldots, u_N)$, and $G$ denotes the set $(G_1, G_2, \ldots, G_M)$.

A function $G_j (j = 1, 2, \ldots, M)$ is defined to be nonlinear if the corresponding output $v$ cannot be expressed in the form $$v_j = g_{1j}u_1 + g_{2j}u_2 + \ldots + g_{Nj}u_N \quad (3)$$

for all admissible values of $u$, where $g_{1j}, g_{2j}, \ldots, g_{Nj}$ are weighting constants independent of $u$.

A relationship of the form eq. (3) is commonly described as linear. Examples of nonlinear relationships are:

$$v_1 = g_{11}u_1 + g_{21}u_2 + g_{31}u_1u_2 + G_{41}u_3^2 \quad (4)$$

and $$v_2 = K\sin(au_1 + bu_2), \quad (5)$$

where $g_{11}, g_{21}, g_{31}, g_{41}, K, a, b$, are constants.

Definition 2 — Nonlinear Device

An electronic device with one or more inputs (i.e. $N \geqslant 1$) and one or more outputs (i.e., $M \geqslant 1$) which performs a nonlinear operation as defined in Definition 1 will be termed a "nonlinear device."

Definition 3 — Distortion

Suppose an electronic device with one or more inputs and one or more outputs be desired to ideally perform operations, either linear or nonlinear, according to eq. (1). Suppose further that an imperfect realization of such an ideal device performs an operation described in vector notation by the expression:

$$w = F(u) \quad (6)$$

where $F$ denotes the function set $(F_1, F_2, \ldots, F_M)$, $w$ denotes the set $(w_1, w_2, \ldots, w_M)$ of output variables of the imperfect device, and $u$ is as previously defined. Since the device is assumed to be imperfect, $F$ will not in general be identical to $G$, so that $w$ will not in general equal $v$. The distortion is defined as the difference between the actual outputs $w_1, w_2, \ldots, w_M$ and the corresponding desired outputs $v_1, v_2, \ldots, v_M$. In vector notation this may be written as $$d = w - v, \quad (7)$$

where $d$ is the set of distortion signals $(d_1, d_2, \ldots, d_M)$.

Definition 4 — Order of Distortion

It is usually possible, at least approximately, to express each of $d_1, d_2, \ldots, d_M$ as a weighted sum of products of variables selected one or more times from the set $(u_1, u_2, \ldots, u_N)$. For example, for a single output device with three inputs, the distortion $d_1$ may be expressed in the form:

$$\begin{aligned} d_1 = {} & a_o + b_1u_1 + b_2u_2 + b_3u_3 + c_1u_1^2 + c_2u_2^2 + c_3u_3^2 \\ & + c_{12}u_1u_2 + c_{23}u_2u_3 + c_{31}u_3u_1 \\ & + e_1u_1^3 + e_2u_2^3 + e_3u_3^3 \\ & + (\text{terms of the form } e_{123}u_1u_2u_3) \\ & + (\text{terms of the form } e_{23}u_2^2u_3) \\ & + (\text{terms involving 4th degree products of } u_1, u_2, u_3 \\ & \quad \text{in any combination}) \\ & + \ldots \end{aligned} \quad (8)$$

where $a_o, b_1, b_2, b_3, c_1, c_2, c_3, c_{12}, c_{23}, c_{31}, e_1, e_2, e_3, e_{123}, e_{23}$ are constants independent of $u_1$, $u_2$ and $u_3$. Some of those constants could be zero.

Each additive term in an expression of the form in eq. (8) is denoted a *distortion product*.

A distortion product is said to be *zeroth-order* when it is a constant, i.e., not dependent on any of $u_1, u_2, \ldots, u_N$ (e.g. $a_o$ in eq. (8) ). A distortion product is said to be $k^{th}$ - *order* when it is composed of a multiplicative product of total degree $k$ in one or more of $u_1, u_2, \ldots, u_N$. (e.g. a distortion product of the form $u_1u_2^2u_3u_4^5$ is 9th-order).

Definition 5 — Multiplier

For the purposes of this specification the term "multiplier" will be used to denote a device, and in particular an electronic device, with two or more inputs and one or more outputs whose principal desired function is to perform multiplicative operations on two, or more input signals, each of which may be involved one or more times in the multiplication product. For example, using the notation of Definition 1, for a two-output, three-input multiplier, the multiplier may ideally be expected to perform operations such as:

$$v_1 = K_1 \cdot u_1 \cdot u_2 \cdot u_3 \quad (9)$$

or $$v_2 = K_2 \cdot u_2 \cdot u_3, \text{ etc.} \quad (10)$$

The description of the present invention now follows:

The present invention is characterised in a nonlinear device having two or more inputs and one or more outputs, of cross-feed signals to reduce distortion products in the system. Although, for the purposes of simplifying the following exposition, the examples below all refer to two-input, single output multipliers, the invention can by obvious extensions be applied equally well to multipliers having two or more inputs and one or more outputs, and to other nonlinear devices having two or more inputs and one or more outputs.

The invention is hereinafter described with reference to the accompanying drawings in which FIG. 1 is a diagram of a distortion model for an imperfect two-input single-output multiplier.

The two inputs of two-input multiplier will be denoted by "X-input" and "Y-input" respectively. The symbols "X" and "Y" will be used to denote the values of the corresponding electrical quantities at these inputs (usually voltages or currents). The output quantity Z, which is the value of an electrical quantity (usually a voltage or a current) at the output of the multiplier, is ideally proportional to the product of X and Y:

$$Z = KXY \quad (11)$$

where K is a constant dependent only on the particular multiplier. In practice the output will depart from this ideal and may be expressed in the form, $$Z = Z_o + K(X + X_o)(Y + Y_o) + a_x X^2 + a_y Y^2 + \text{higher order terms} \quad (12)$$

where

- $Z_o$ is a constant offset appearing at the output (output offset),
- $X_o$ and $Y_o$ are constant offsets associated with the respective input terminals,
- $a_x$, $a_y$ are constant factors related to second-order distortion.

Figure 1:
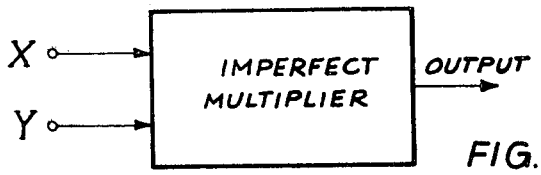

The distortion model is illustrated diagrammatically in FIG. 1. The constants in the foregoing expression are considered to be independent of the multiplier input quantities, but their values could in practice depend on the temperature, operating points or other environmental factors.

Let us suppose that the actual signals whose product is desired are $x$ and $y$. That is, the desired output from the multiplier is $$z = Kxy \quad (13)$$

where $K$ is a constant. It is current practice when using imperfect multipliers described by equation (12) to provide external circuitry for the reduction or cancellation of the offset terms $X_o$, $Y_o$ and $Z_o$. This external circuitry operates by adding appropriate components $x_o$, $y_o$ and $z_o$ to $x$, $y$ and $z$, respectively, so that the signals applied to the imperfect multiplier inputs are $$X = x + x_o \quad (14)$$

and $$Y = y + y_o \quad (15)$$

and the new output signal is given by $$z = Z + z_o \quad (16)$$

Values of $x_o$, $y_o$ and $z_o$ are commonly chosen to reduce or eliminate the undesired effects of $X_o$, $Y_o$ and $Z_o$, as discussed further below.

Figure 2:
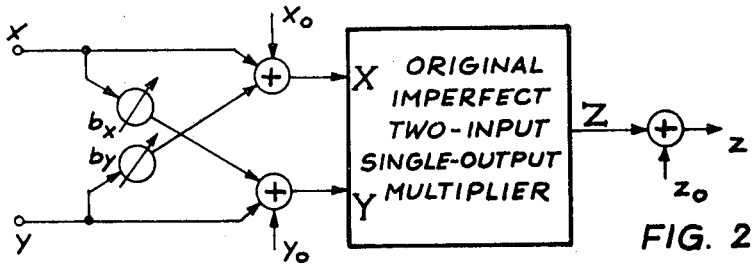
FIG. 2 is a diagram showing schematically the principle of the present invention as applied to an imperfect two-input single-output multiplier.

These adjustments, hereinafter referred to as "offset adjustments," do not in general reduce distortion of order higher than unity. The purpose of the present invention is to provide additional external adjustments, hereinafter referred to as "cross-feed adjustments," to reduce or cancel higher-order distortion (especially, the second-order distortion). The essence of the method of the present invention lies in the exploitation of the normal function of the nonlinear device to generate additional output products, the magnitude and polarity of which are adjusted to cancel, as accurately as practicable, undesirable distortion products of similar form already present in the output due to imperfections in the characteristics of the nonlinear device. In the special case of the single-output two-input multiplier, this is achieved by cross-feeding a small portion $b_x x$ of the signal $x$ into the imperfect multiplier Y-input, and a portion $b_y y$ of the signal y into its X-input, where $b_x$ and $b_y$ are constants, at least one of which must be non-zero. These cross-feed adjustments may be effected in conjunction with the usual offset adjustments, or independently, as desired. In the following we will consider the general case in which the offset and cross-feed adjustments are performed in conjunction. The signals applied to the imperfect multiplier inputs are thereby:

$$X = x + x_o + b_y y \quad (17)$$

and $$Y = y + y_o + b_x x, \quad (18)$$

as shown schematically in FIG. 2. The output signal z is still given by eq. (16). The overall effect of this arrangement is evaluated by substituting in eq. (12) the quantities in equations (17) and (18) above for $X$ and $Y$ respectively. In accordance with this substitution, and with the provision of an output offset compensation term $z_o$, the expression for the output becomes:

$$\begin{aligned} z = {} & Z_o + z_o + K[(x_o + Y_o)(y_o + Y_o) + a_x x_o^2 + a_y y_o^2] \\ & + K\,xy\,[1 + b_x b_y + 2(b_y a_x + b_x a_y)] \\ & + x[(y_o + Y_o) + b_x(x_o + Y_o + 2a_y y_o) + 2a_x x_o] \\ & + y[(x_o + Y_o) + b_y(y_o + Y_o + 2a_x x_o) + 2a_y y_o] \\ & + x^2(b_x + a_x + a_y b_x^2) + y^2(b_y + a_y + a_x b_y^2) \\ & + [\text{other minor cross-feed components}] \\ & + [\text{higher order terms}] \end{aligned} \quad (19)$$

where minor cross-feed components not given explicitely in eq. (19) are normally negligible low-order terms produced by the substitutions of eqs. (17) and (18) into higher order terms in eq. (12).

In equation (19), the $xy$ term is the desired output; the other terms are distortion products. The effects of these may be minimized by assigning appropriate values to $x_o$, $y_o$, $z_o$, $b_x$, $b_y$, as required for each individual device. Prior to the present invention, compensation was limited to compensation of the 1st-order distortion products. The present invention also allows for compensation of 2nd-order distortion products. A practical method of effecting the optimum adjustment of $x_o$, $y_o$, $z_o$, $b_x$ and $b_y$ is described further on by reference to a working circuit of the invention. The characteristics of devices normally encountered in practice are such that the coefficients $a_x$ and $a_y$ may be considered small in relation to unity. Accordingly, values of $b_x$ and $b_y$ which minimize the $x^2$ and $y^2$ terms are approximately given by, $$b_x = -a_x \quad (20)$$

$$b_y = -a_y \quad (21)$$

In the foregoing example (corresponding to FIG. 2) the cross-feed principle has been described in terms of linear cross-feed only. For example, input signal $x$ is cross-fed to the imperfect multiplier Y-input without any functional modification other than multiplication by the constant weighting factor $b_x$. According to the present invention, the imperfect nonlinear device may be more general than the multiplier in FIG. 2 and it is also permissible to incorporate in the cross-feed connections for this more general device (as defined by eq. (6)) additional devices which have the effect of combining one, two, or more of the input signals $u_1, u_2, \ldots, u_N$, by means of operations, which may be nonlinear (of the general form as in eq. (1)), before application to the inputs of the original imperfect nonlinear device defined by eq. (6).

Figure 3:
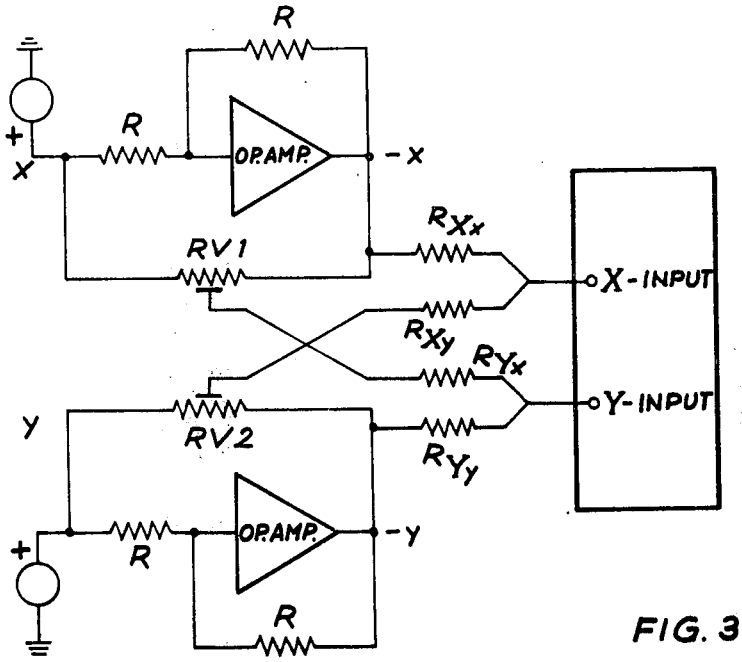
FIGS. 3 and 4 are diagrams showing applications of the present invention.
Figure 4:
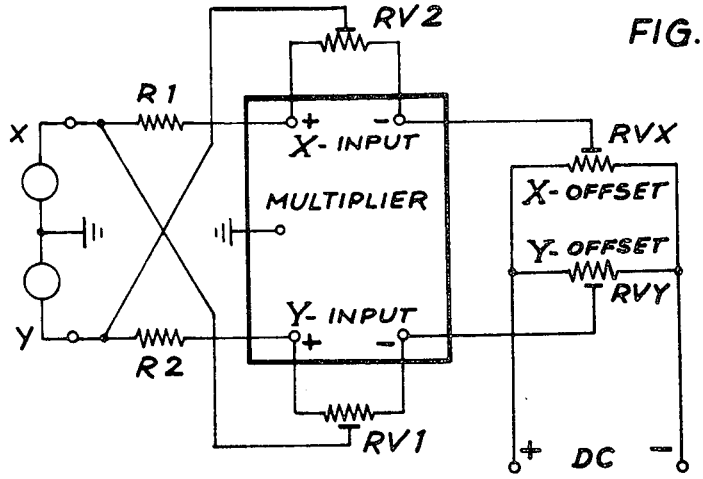
Figure 5:
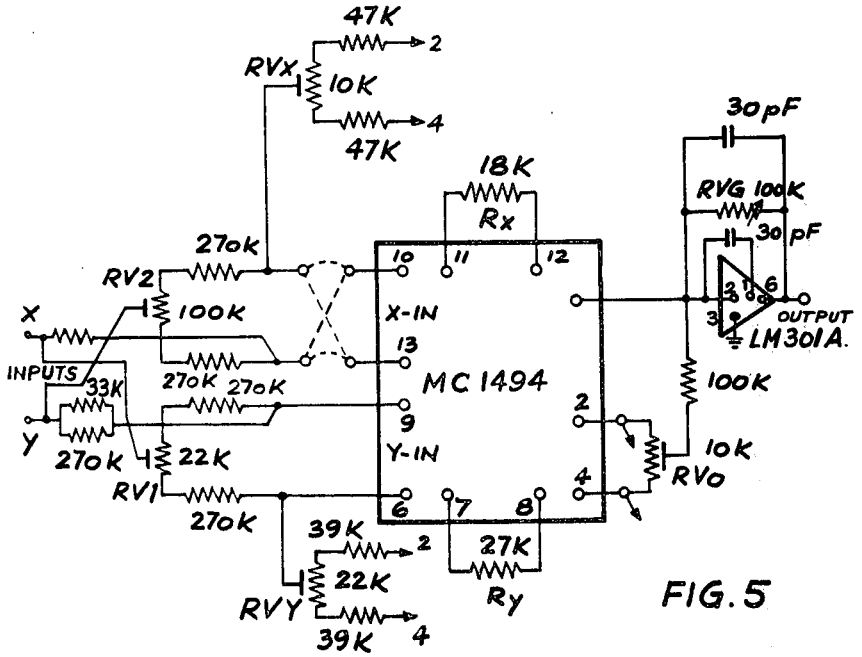
FIG. 5 is a detailed working circuit of the present invention in conjunction with a commercially available integrated circuit multiplier unit.

Embodiments of the invention are shown in FIGS. 3, 4 and 5. The arrangement in FIG. 3 is suitable for use with a multiplier with single-ended input terminals. The inverter circuits (consisting of the additional operational amplifiers and the resistors labelled R) allow compensation of either polarity.

The arrangement of FIG. 4 is suitable for use with a multiplier with differential input terminals. The current dividers RV1 and RV2 across each pair of input terminals provide for compensation of either polarity. FIG. 5 shows a detailed working circuit of the present invention as applied to a commercially available integrated circuit analog multiplier unit. In this embodiment, which is a special case of the circuit in FIG. 4, the resistive divider implemented by the variable resistor RV1 controls mainly the value of $b_x$. The value of $b_y$ is similarly mainly controlled by RV2. RV1 and RV2 are the cross-feed adjustors. RVX controls mainly $x_o$, RVY controls mainly $y_o$, RVO controls mainly $z_o$. RVG controls K. RVX, RVY and RVO are the offset adjustors. The resistive controls may in practice partly affect parameters other than those upon which they are designed to exercise primary control, so that adjustment procedures may need to be repeated several times before convergence is obtained.

It will be apparent from the example in FIG. 5 that the cross-feed principle can be implemented cheaply and with very little additional circuitry. It will also be apparent from the description of the adjustment procedure described below that the adjustment of the cross-feed network is very straightforward.

A method for the optimum adjustment of cross-feed weights is now described by way of example with particular reference to the circuit of FIG. 5. However, the method is general and is suitable for use, with modification if required, in any combination of the following situations:

a. with nonlinear devices other than multipliers;
b. where the number of cross-feed connections is other than two;
c. where the number of outputs is greater than one;
d. where additional nonlinear devices are incorporated within the cross-feed connections; and e. where the number of inputs is greater than two.

In the implementation of the adjustment procedure, a test signal is required whose peak-to-peak value can be made as large as the range of expected input signal values. A signal is connected to one input first, say the x-input of the overall multiplier with compensating circuitry, and a zero signal is connected to the other input. The output is connected to the vertical deflection input of a cathode ray oscilloscope (CRO). The test signal (which is already connected to the multiplier $x$-input) is also connected to the CRO horizontal deflection input. The CRO is adjusted to produce a display of convenient amplitude. Variable resistors RV1 and RVY in the multiplier circuit are adjusted to minimize the peak-to-peak vertical deflection of the CRO trace. Similarly, with the test signal now applied to the multiplier $y$-input (and still connected to the CRO horizontal input) and a zero signal applied to the $x$-input, RV2 and RVX are adjusted for further reduction of vertical displacement of the CRO trace. RVO may be similarly adjusted in conjunction with either or both of the foregoing test arrangements, or alternatively with a zero signal applied to both multiplier inputs simultaneously. The procedure may be repeated as many times as necessary for convergence. RVG is an independent adjustment for setting the overall gain factor (K) of the multiplier, which is best left as the last adjustment, and performed according to well known methods. In applications with more than two inputs, a non-zero test signal is applied to one input only at a time. In applications with more than one output, each output may be displayed simultaneously either through the use of a multi-trace CRO, or additional CRO's.

What we claim is:

1. A method for the reduction of undesired second and higher order distortion products present in the signal(s) $w_1, w_2, \ldots, w_M$ appearing at the M outputs of an imperfect nonlinear electronic device which has input signals $u_1, u_2, \ldots, u_N$ applied to its N inputs, where N is an integer greater than unity and M is an integer greater than zero, and where input $u_n$ is applied to the $n$-th input, $n$ being an integer lying between 1 and N inclusive, which comprises the steps of:

incorporating cross-feed connections at the inputs of the non-linear electronic device, and generating by use of the cross-feed connections signals $u_1'u_2', \ldots, u_N'$ from the input signals $u_1, u_2, \ldots, u_N$ such that at least one of the signals $u_1', u_2', \ldots, u_N'$ is a non-trivial function of at least two of the signals $u_1, u_2, \ldots, u_N$ and such that the signal $u_N$ is a non-trivial function of at least the signal $u_N$, where $n$ is an integer between 1 and N inclusive, and applying the signals $u_1', u_2', \ldots, u_N'$ to the N inputs of the electronic device instead of applying the input signals $u_1, u_2, \ldots, u_N$ directly to the N inputs so that the undesired second and higher order distortion products are reduced.

2. A method as claimed in claim 1 in which the functional relation between the signal $u_n'$ and $u_n$ is linear, where n is any integer between 1 and N inclusive.

3. A method as claimed in claim 1 wherein the functional relations between the signals $u_1', u_2', \ldots, u_N'$ and $u_1, u_2, \ldots, u_N$ are individually linear.

4. A method as claimed in claim 1 wherein the imperfect nonlinear electronic device is ideally a general multiplier with N inputs and M outputs.

5. A method as claimed in claim 1 wherein the imperfect nonlinear electronic device has two inputs and one output.

6. A method as claimed in claim 4 wherein the multiplier has two inputs and one output.

7. A method as claimed in claim 4 which comprises the step of utilizing as the imperfect nonlinear device an electronic analogue multiplier in which none of the $M+N$ input and output variables $u_1, u_2, \ldots, u_N$ and $w_1, w_2, \ldots, w_M$ is subjected to a quantization operation.

8. A method as claimed in claim 6 wherein the multiplier inputs are unbalanced with respect to earth, and the operational amplifier inverter arrangement provides for compensation of either polarity.

9. A method as claimed in claim 6 wherein the multiplier inputs are balanced with respect to earth.

* * * * *